US007971441B2

(12) United States Patent
Salim et al.

(10) Patent No.: US 7,971,441 B2
(45) Date of Patent: Jul. 5, 2011

(54) RECEIVER/DRYER-ACCUMULATOR-INTERNAL HEAT EXCHANGER FOR VEHICLE AIR CONDITIONING SYSTEM

(75) Inventors: Munther M. Salim, Villa Park, IL (US); Lawrence P. Ziehr, Clarkston, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 921 days.

(21) Appl. No.: 11/924,675

(22) Filed: Oct. 26, 2007

(65) Prior Publication Data

US 2009/0107172 A1 Apr. 30, 2009

(51) Int. Cl.
*F25B 1/00* (2006.01)

(52) U.S. Cl. ..... 62/115; 62/503

(58) Field of Classification Search ..... 62/83, 474, 62/503, 509, 513, 115
See application file for complete search history.

(56) References Cited

U.S. PATENT DOCUMENTS 4,341,092 A * 7/1982 Davis ..... 62/475
6,330,810 B1 * 12/2001 Yamazaki et al. ..... 62/509
6,385,994 B2 * 5/2002 Schroeder et al. ..... 62/503

FOREIGN PATENT DOCUMENTS

DE 19959566 A1 6/2001
DE 102006007371 A1 8/2007

* cited by examiner

*Primary Examiner* — Mohammad Ali

(57) ABSTRACT

An integrated receiver/dryer-accumulator-internal heat exchanger for use in a vehicle HVAC system and a method of operation. The integrated receiver/dryer-accumulator-internal heat exchanger may include an accumulator portion having an accumulator inlet configured to be in fluid communication with an evaporator, and an accumulator outlet configured to be in fluid communication with a compressor; and a receiver/dryer portion mounted within the accumulator portion and having receiver/dryer inlet configured to be in fluid communication with a first portion of a condenser and a receiver/dryer outlet configured to be in fluid communication with a sub-cooler portion of the condenser. The integrated receiver/dryer-accumulator-internal heat exchanger allows for exchanging heat between the refrigerant in the accumulator portion and refrigerant in the receiver/dryer portion.

18 Claims, 2 Drawing Sheets

RECEIVER/DRYER-ACCUMULATOR-INTERNAL HEAT EXCHANGER FOR VEHICLE AIR CONDITIONING SYSTEM

BACKGROUND OF INVENTION

The present invention relates generally to heating ventilating and air conditioning (HVAC) systems for vehicles, and more particularly to an air conditioning portion of vehicle HVAC systems.

A conventional air-conditioning system for a vehicle may include an engine driven compressor that compresses a refrigerant before it is directed into a condenser in order to remove heat from the refrigerant. The refrigerant is then directed from the condenser through an expansion device, such as a thermal expansion valve or an orifice tube, before being directed through an evaporator in the vehicle heating, ventilation and air conditioning (HVAC) module. After cooling the air flowing into the passenger cabin, the refrigerant is directed back to the compressor. The conventional air-conditioning systems also typically include an accumulator between the evaporator and compressor, or a receiver/dryer between the condenser and expansion device. Some have both an accumulator between the evaporator and compressor and a separate receiver/dryer between the condenser and expansion device. The accumulator and receiver/dryer remove moisture from the refrigerant and store extra refrigerant. The accumulator may also help to keep liquid refrigerant from entering the compressor, reducing the risk that liquid refrigerant will damage the compressor. Accordingly, the accumulator and receiver/dryer help to provide optimum operating conditions for the system.

These conventional air conditioning systems for vehicles require a significant amount of energy to operate, thus taking away from the vehicle's fuel efficiency. Consequently, more efficient air conditioning systems are desirable that still provide optimum operating conditions for the system.

SUMMARY OF INVENTION

An embodiment contemplates an integrated receiver/dryer-accumulator-internal heat exchanger for use in an air conditioning portion of a vehicle HVAC system. The integrated receiver/dryer-accumulator-internal heat exchanger may comprise an accumulator portion having an accumulator inlet configured to be in fluid communication with an evaporator, and an accumulator outlet configured to be in fluid communication with a compressor; and a receiver/dryer portion mounted within the accumulator portion and having receiver/dryer inlet configured to be in fluid communication with a first portion of a condenser and a receiver/dryer outlet configured to be in fluid communication with a sub-cooler portion of the condenser.

An embodiment contemplates a heating, ventilation and air-conditioning (HVAC) system for use in a vehicle. The HVAC system may comprise a compressor; a condenser having a first portion in fluid communication with the compressor, and a sub-cooler portion; an expansion device in fluid communication with the sub-cooler portion; an evaporator in fluid communication with the expansion device; and an integrated receiver/dryer-accumulator-internal heat exchanger. The integrated receiver/dryer-accumulator-internal heat exchanger may have an accumulator portion with an accumulator inlet in fluid communication with the evaporator and an accumulator outlet in fluid communication with the compressor, and a receiver/dryer portion mounted within the accumulator portion and having receiver/dryer inlet in fluid communication with the first portion and a receiver/dryer outlet in fluid communication with the sub-cooler portion of the condenser.

An embodiment contemplates a method of operating a vehicle heating, ventilation and air conditioning system, the method comprising the steps of: compressing a refrigerant before directing the refrigerant through a first portion of a condenser; directing the refrigerant from the first portion through a receiver/dryer portion of an integrated receiver/dryer-accumulator-internal heat exchanger; directing the refrigerant from the receiver/dryer portion through a sub-cooler portion of the condenser; directing the refrigerant from the sub-cooler through an expansion device; directing the refrigerant from the expansion device through an evaporator; directing the refrigerant from the evaporator into an accumulator portion of the integrated receiver/dryer-accumulator-internal heat exchanger surrounding the receiver/dryer portion; exchanging heat between the refrigerant in the accumulator portion and refrigerant in the receiver/dryer portion; and directing refrigerant from the accumulator portion to a compressor.

An advantage of an embodiment is that the condenser performance and coefficient of performance in vapor compression refrigerant systems are improved. Thus, the evaporator cooling capacity is enhanced.

An advantage of an embodiment is that the integrated heat exchanger cools the liquid out of the first portion of the condenser with the cold vapor out of the evaporator, thus increasing sub-cooling.

An advantage of an embodiment is that the refrigerant line from the accumulator to the compressor can be located so that it starts from near the top of the accumulator to ensure that only vapor enters the compressor, thus reducing concerns with slugging, which can be harmful to the compressor.

An advantage of an embodiment is that equivalent comfort, as compared to conventional air conditioning systems, can be attained using lower compressor power consumption, which may lead to improved fuel economy for the vehicle. It may also delay the onset of high fan speed request, and may improve noise, vibration and harshness (NVH) concerns.

DETAILED DESCRIPTION

Figure 1:
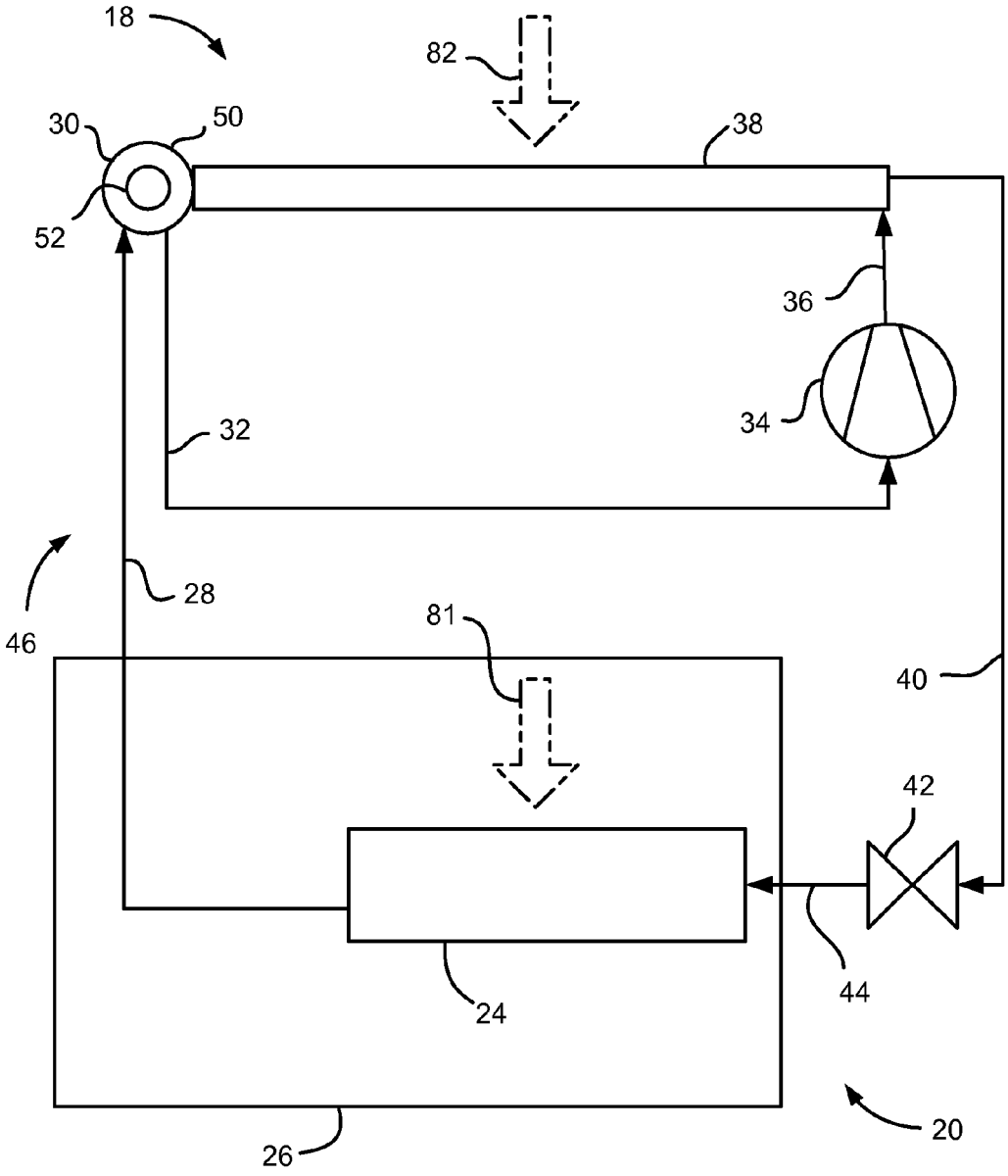
FIG. 1 is a schematic view of an air conditioning portion of a vehicle HVAC system.
Figure 2:
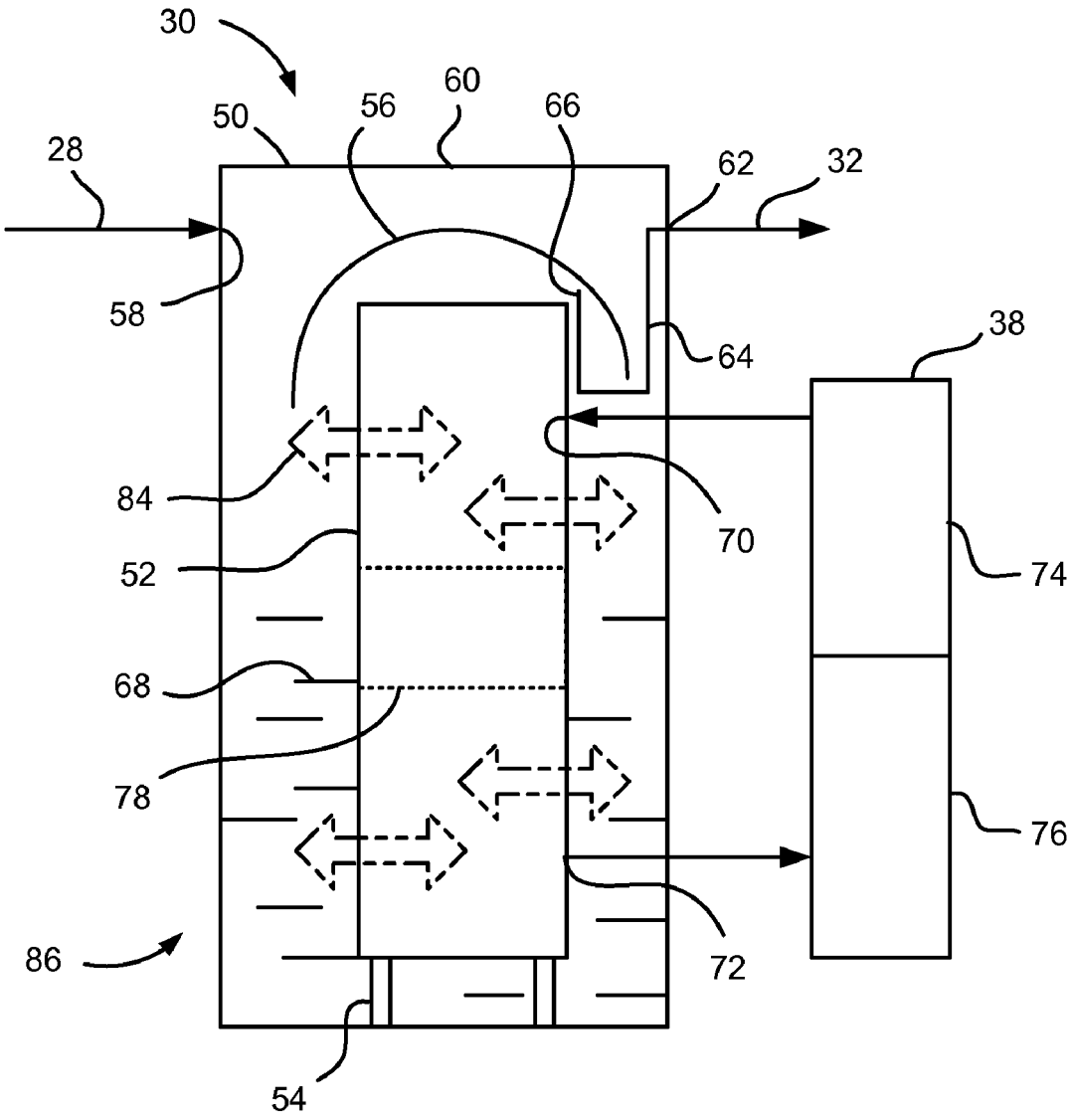
FIG. 2 is a schematic view of an integrated receiver/dryer-accumulator-internal heat exchanger for use in the HVAC system of FIG. 1.

Referring to FIGS. 1-2, an air conditioning portion 18 of a heating, ventilation and air conditioning (HVAC) system 20 is shown. The air conditioning portion 18 includes an evaporator 24 located in a passenger cabin HVAC module 26. A refrigerant line 28 directs refrigerant from the evaporator 24 to an integrated receiver/dryer-accumulator-internal heat exchanger (RDAIX) 30. A refrigerant line 32 directs refrigerant from the RDAIX 30 to a refrigerant compressor 34. A refrigerant line 36 directs refrigerant from the compressor to a condenser 38. The refrigerant in the condenser 38 is directed through the (RDAIX) 30 and back into the condenser 38. The RDAIX 30 may be mounted on the condenser 38, if so desired. A refrigerant line 40 directs refrigerant from the condenser 38 to an expansion device 42. The expansion device 42 is preferably a thermal expansion valve, but maybe an orifice tube, if so desired. A refrigerant line 44 directs refrigerant from the expansion device 42 back to the evaporator 24, completing a refrigerant loop 46.

The RDAIX 30 includes an accumulator portion 50 generally shaped like a cylindrical tank, within which is mounted a receiver/dryer portion 52 which may also be shaped like a cylindrical tank. Structural supports 54 may hold the receiver/dryer portion 52 in place relative to the accumulator portion 50. These structural supports 54 may take any shape or form desired for maintaining the spacing of the receiver/dryer portion 52 relative to the accumulator portion 50. An arcuate dome 56 is mounted in an upper portion of the accumulator portion 50 above the receiver/dryer portion 52.

The accumulator portion 50 includes an accumulator inlet 58 that is located adjacent to the dome 56 near the top 60 of the accumulator portion 50. The refrigerant line 28 directs refrigerant to the accumulator inlet 58. The accumulator portion 50 includes an accumulator outlet 62 that is also located near the top 60. The accumulator outlet 62 connects to refrigerant line 32. The accumulator outlet 62 may also include a conduit 64 extending to the underside of the dome 56, with an inlet 66 of this conduit 64 facing upward under the dome 56. The accumulator portion 50 may also include heat transfer elements 68, such as fins or turbulator tapes, located adjacent to the receiver/dryer portion 52.

The receiver/dryer portion 52 includes a receiver/dryer inlet 70 for receiving refrigerant from a first portion 74 of the condenser 38, and a receiver/dryer outlet 72 for directing refrigerant from the receiver/dryer portion 52 into a sub-cooler portion 76 of the condenser 38. A desiccant 78 may be located in the receiver/dryer portion 52 between the inlet 70 and the outlet 72.

The operation of the air-conditioning system 18 will now be described. When the refrigerant compressor 34 is activated, it compresses the refrigerant and directs it through refrigerant line 36 into the first portion 74 of the condenser 38. Air flow (indicated by phantom arrow 82 in FIG. 1) through the condenser 38 absorbs heat from the refrigerant. The refrigerant is then directed from the first portion 74, through the receiver/dryer inlet 70, into the receiver portion 52 of the RDAIX 30. As it flows through the desiccant 78, moister is removed from the refrigerant. Also, heat is transferred (indicated by the phantom double headed arrows 84 in FIG. 2) from the refrigerant in the receiver/dryer portion 52 to the refrigerant in the accumulator portion 50. The refrigerant then flows through the outlet 72 and into the sub-cooler portion 76 of the condenser 38, where the air flow 82 removes additional heat. The heat exchange between the refrigerant in the receiver/dryer portion 52 and the accumulator portion 50 results in a cooler refrigerant flowing into the sub-cooler portion 76.

After leaving the condenser 38, the refrigerant is directed through refrigerant line 40 to the expansion device 42, where the pressure, and hence temperature, are lowered. The cooled refrigerant is then directed through refrigerant line 44 into the evaporator 24. Air flow (indicated by the phantom arrow 81 in FIG. 1) through the evaporator 24 gives off heat to the refrigerant. The refrigerant is then directed through refrigerant line 28 to the RDAIX 30.

The refrigerant enters the accumulator portion 50 through the accumulator inlet 58 and impinges on the dome 56. This allows for the liquid refrigerant to settle to the bottom of the accumulator portion 50 while the vapor rises to the top. The liquid refrigerant settling to the bottom of the accumulator portion 50 will flow around the heat transfer elements 68 along the outer surface of the receiver/dryer portion 52, allowing for heat transfer from the refrigerant in the receiver/dryer portion 52 into the refrigerant in the accumulator portion 50. Thus, the outer surface of the receiver/dryer portion 52 and the heat transfer elements 68 form an integrated heat exchanger, indicated generally at 86, within the RDAIX 30.

The refrigerant is then sucked from near the top 60 of the accumulator portion 50 to the compressor 34. Preferably, the refrigerant is sucked in through the upward facing inlet 66 from under the dome 56. This refrigerant near the top 60 will be vapor and hence reduce or eliminate any potential compressor slugging concerns.

While certain embodiments of the present invention have been described in detail, those familiar with the art to which this invention relates will recognize various alternative designs and embodiments for practicing the invention as defined by the following claims.

What is claimed is:

1. An integrated receiver/dryer-accumulator-internal heat exchanger for use in an air conditioning portion of a vehicle HVAC system, the integrated receiver/dryer-accumulator-internal heat exchanger comprising:

an accumulator portion having an accumulator inlet configured to be in direct fluid communication with an evaporator, and an accumulator outlet configured to be in direct fluid communication with a compressor; and a receiver/dryer portion mounted within the accumulator portion and having receiver/dryer inlet configured to be in direct fluid communication with a first portion of a condenser and a receiver/dryer outlet configured to be in direct fluid communication with a sub-cooler portion of the condenser.

2. The integrated receiver/dryer-accumulator-internal heat exchanger of claim 1 including a heat transfer element located in the accumulator portion adjacent to the receiver/dryer portion.

3. The integrated receiver/dryer-accumulator-internal heat exchanger of claim 2 wherein the heat transfer element is turbulator tape.

4. The integrated receiver/dryer-accumulator-internal heat exchanger of claim 1 wherein the accumulator portion includes a dome extending above the receiver/dryer portion.

5. The integrated receiver/dryer-accumulator-internal heat exchanger of claim 4 wherein the accumulator outlet includes a conduit extending under the dome and the conduit includes an inlet facing upward under the dome.

6. The integrated receiver/dryer-accumulator-internal heat exchanger of claim 1 wherein the accumulator inlet and the accumulator outlet are located adjacent to a top of the accumulator portion.

7. The integrated receiver/dryer-accumulator-internal heat exchanger of claim 1 including structural supports holding the receiver/dryer portion in spaced relation relative to the accumulator portion.

8. The integrated receiver/dryer-accumulator-internal heat exchanger of claim 1 wherein the receiver/dryer portion includes a desiccant between the receiver/dryer inlet and the receiver/dryer outlet.

9. A heating, ventilation and air-conditioning system for use in a vehicle comprising:

a compressor;

a condenser having a first portion in fluid communication with the compressor, and a sub-cooler portion;

an expansion device in fluid communication with the sub-cooler portion;

an evaporator in fluid communication with the expansion device; and an integrated receiver/dryer-accumulator-internal heat exchanger having an accumulator portion with an accumulator inlet in direct fluid communication with the evaporator and an accumulator outlet in direct fluid communication with the compressor, and a receiver/dryer portion mounted within the accumulator portion and having receiver/dryer inlet in direct fluid communication with the first portion and a receiver/dryer outlet in direct fluid communication with the sub-cooler portion of the condenser.

10. The heating, ventilation and air-conditioning system of claim 9 wherein the integrated receiver/dryer-accumulator-internal heat exchanger is mounted on the condenser.

11. The heating, ventilation and air-conditioning system of claim 9 wherein the integrated receiver/dryer-accumulator-internal heat exchanger includes a heat transfer element located in the accumulator portion adjacent to the receiver/dryer portion.

12. The heating, ventilation and air-conditioning system of claim 9 wherein the integrated receiver/dryer-accumulator-internal heat exchanger includes a dome in the accumulator portion extending above the receiver/dryer portion.

13. The heating, ventilation and air-conditioning system of claim 12 wherein the accumulator outlet includes a conduit extending under the dome and the conduit includes an inlet facing upward under the dome.

14. The heating, ventilation and air-conditioning system of claim 9 wherein the accumulator inlet and the accumulator outlet are located adjacent to a top of the accumulator portion.

15. The heating, ventilation and air-conditioning system of claim 9 wherein the expansion device is a thermal expansion valve.

16. The heating, ventilation and air-conditioning system of claim 9 wherein the integrated receiver/dryer-accumulator-internal heat exchanger includes structural supports holding the receiver/dryer portion in spaced relation relative to the accumulator portion.

17. A method of operating a vehicle heating, ventilation and air conditioning system, the method comprising the steps of:

(a) compressing a refrigerant before directing the refrigerant through a first portion of a condenser;

(b) directing the refrigerant from the first portion through a receiver/dryer portion of an integrated receiver/dryer-accumulator-internal heat exchanger, the receiver/dryer mounted within a surrounding accumulator portion;

(c) directing all of the refrigerant through a desiccant in the receiver/dryer and from the receiver/dryer portion through a sub-cooler portion of the condenser;

(d) directing the refrigerant from the sub-cooler through an expansion device;

(e) directing the refrigerant from the expansion device through an evaporator;

(f) directing the refrigerant from the evaporator onto a dome in an accumulator portion of the integrated receiver/dryer-accumulator-internal heat exchanger, the dome being mounted above the receiver/dryer portion;

(g) exchanging heat between the refrigerant in the accumulator portion and refrigerant in the receiver/dryer portion; and (h) directing refrigerant from an area under the dome in the accumulator portion between the dome and the receiver/dryer portion, out through an outlet adjacent to the top of the accumulator portion and to a compressor.

18. The method of claim 17 wherein step (g) is further defined by providing heat transfer elements in the accumulator portion adjacent to the receiver/dryer portion for enhancing the exchange of heat between the refrigerant in the accumulator portion and the refrigerant in the receiver/dryer portion.

* * * * *